US005365634A

United States Patent [19]

Hughes

[11] Patent Number: 5,365,634

[45] Date of Patent: Nov. 22, 1994

[54] SURFACE TREATING TOOL

[75] Inventor: Joel Hughes, Wilmington, N.C.

[73] Assignee: Container Products Corporation, Wilmington, N.C.

[21] Appl. No.: 56,750

[22] Filed: May 4, 1993

Related U.S. Application Data

[63] Continuation-in-part of Ser. No. 937,147, Aug. 31, 1992, Pat. No. 5,287,589.

[51] Int. Cl.[5] ..... A47L 5/30

[52] U.S. Cl. ..... 15/366; 15/5; 15/386; 15/387

[58] Field of Search ..... 15/5, 387, 386, 366

[56] References Cited

U.S. PATENT DOCUMENTS

| | | | |
|---|---|---|---|
| 1,952,999 | 3/1934 | Lucke | 15/386 X |
| 2,064,856 | 12/1936 | Riebel | 15/386 X |
| 2,578,549 | 12/1951 | Hooban | 15/366 X |
| 2,854,681 | 10/1958 | Wells et al. | 15/386 X |
| 4,221,018 | 9/1980 | Hajdu | 15/386 X |
| 4,250,592 | 2/1981 | Emrick | 15/366 X |

FOREIGN PATENT DOCUMENTS

| | | | |
|---|---|---|---|
| 295066 | 8/1928 | United Kingdom | 15/386 |
| 335572 | 9/1930 | United Kingdom | 15/386 |

*Primary Examiner*—Chris K. Moore

[57] ABSTRACT

A surface treating tool comprising an interconnected cleaning and stripping device for a self contained automated retrieval cleaning apparatus that provides a vacuum recovery and filtration system, with the tool consisting of a rotary brush mounted in an open bottom housing. The brush provides a core having operative connection to a rotating means and includes rows of radially extending resilient flaps carrying at their distal ends peening elements adapted to have contact through the open bottom of the housing with the surface to be cleaned while such surface is being vacuumed. The core can also provide radially extending wire bristles alternately disposed between the rows of resilient flaps.

8 Claims, 3 Drawing Sheets

SURFACE TREATING TOOL

FIELD OF INVENTION

This is a continuation in part application of application Ser. No. 07/937,147, filed Aug. 31, 1992 now U.S. Pat. No. 5,287,589, issued Feb. 22, 1994.

This invention relates to a rotary brush-like apparatus utilized for material stripping, and more specifically to a rotatable spoke bearing impact tool for stripping lead paint and other toxic material as well as providing a means for vacuum recovery of such material for filtering and containment to permit environmentally safe disposal.

BACKGROUND

Rotary brushes for cleaners having at least one flexible blade extending perpendicularly with respect to the axis of rotation, had been utilized for sweeping into a receptacle dust and debris. The sweeping action is a result of forceful abutting of the blade upon the surface to be cleaned. See for example U.S. Pat. No. 5,056,181.

The known rotary brushes for sweeping and/or stripping surfaces to be cleaned were defective in that the wear of the bristle type blades, was extremely excessive, especially when used for stripping. The rotating stripping elements fixed to the brush core, increasingly lost their capacity to perform their desired function, thus becoming inferior in performance. The demanding replacement of the entire brush core thus increased the costs of the tools in the performance of their desired function.

It is an object of this invention to provide a rotary brush which is especially efficient as well as economical to maintain and/or manufacture.

BRIEF DESCRIPTION OF THE DRAWINGS

The invention will be best understood by reference to the accompanying drawings which illustrate the preferred form of construction and arrangement of parts by which the objects of the invention are achieved, and in which.

DESCRIPTION OF THE INVENTION

Figure 1:
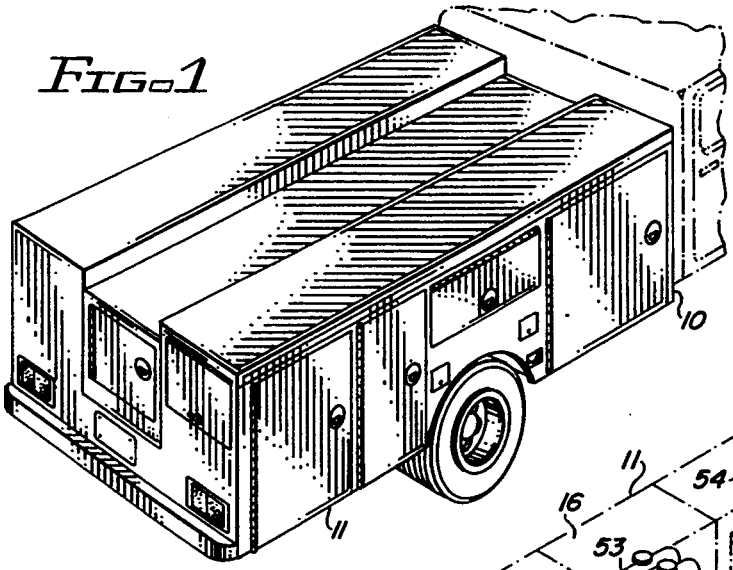
FIG. 1 is a perspective view of the self contained automated retrieval vehicle associated with the present invention.

This invention is an operative element of a totally self contained environmentally safe cleaning apparatus. The apparatus may be carried on a platform or mounted upon a mobile truck bed 10 as illustrated in FIG. 1. In either environment the apparatus consists of a compartmentalized body 11 such as is perspectively shown in FIGS. 1 and 2.

Figure 2:
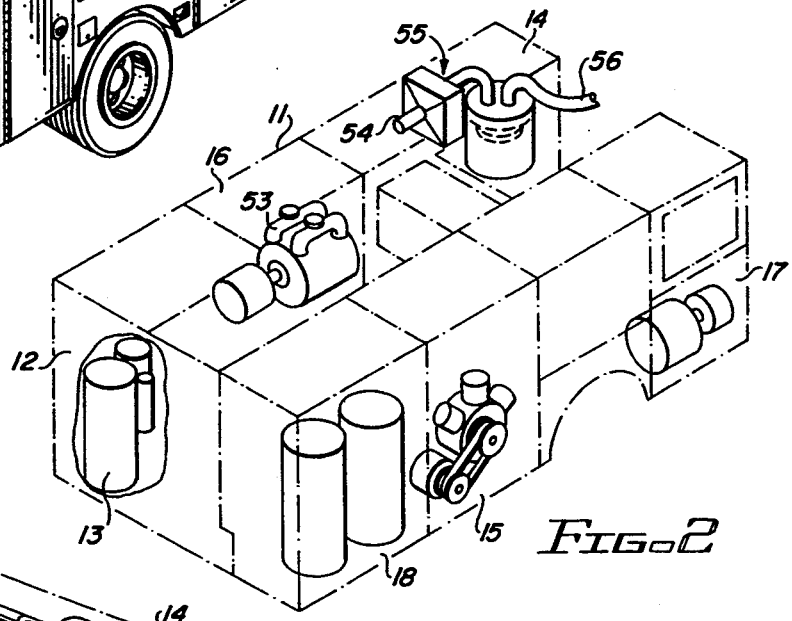
FIG. 2 is a schematic view of the compartmentalized arrangement of the cooperative elements of the invention.

Referring to FIG. 2 there is schematically illustrated the relationship of the interconnected compartments, wherein compartment 12 houses the main circulating pump and super heater 13, compartment 14 houses the air/particle separator and Hepa filter, while compartment 15 houses an air compressor. Compartment 16 holds the liquid ring pump which creates the collection vacuum throughout the system. Compartment 17 contains the generator and hydraulic motor while compartment 18 receives the compressed air tanks utilized in this system.

The rotary tool of this invention is adapted to be hand held and as such provides a hood type housing 19, consisting of a top wall 20, side walls 21 and 22, any end walls 23 and 24. The hood 19 as described provides an open bottom area adapted to be appositioned to the surface to be cleaned.

Attached to the top wall 20, by suitable uprights 25 is a handle 26, extending in a plane perpendicular to the side walls 21 and 22.

Figure 3:
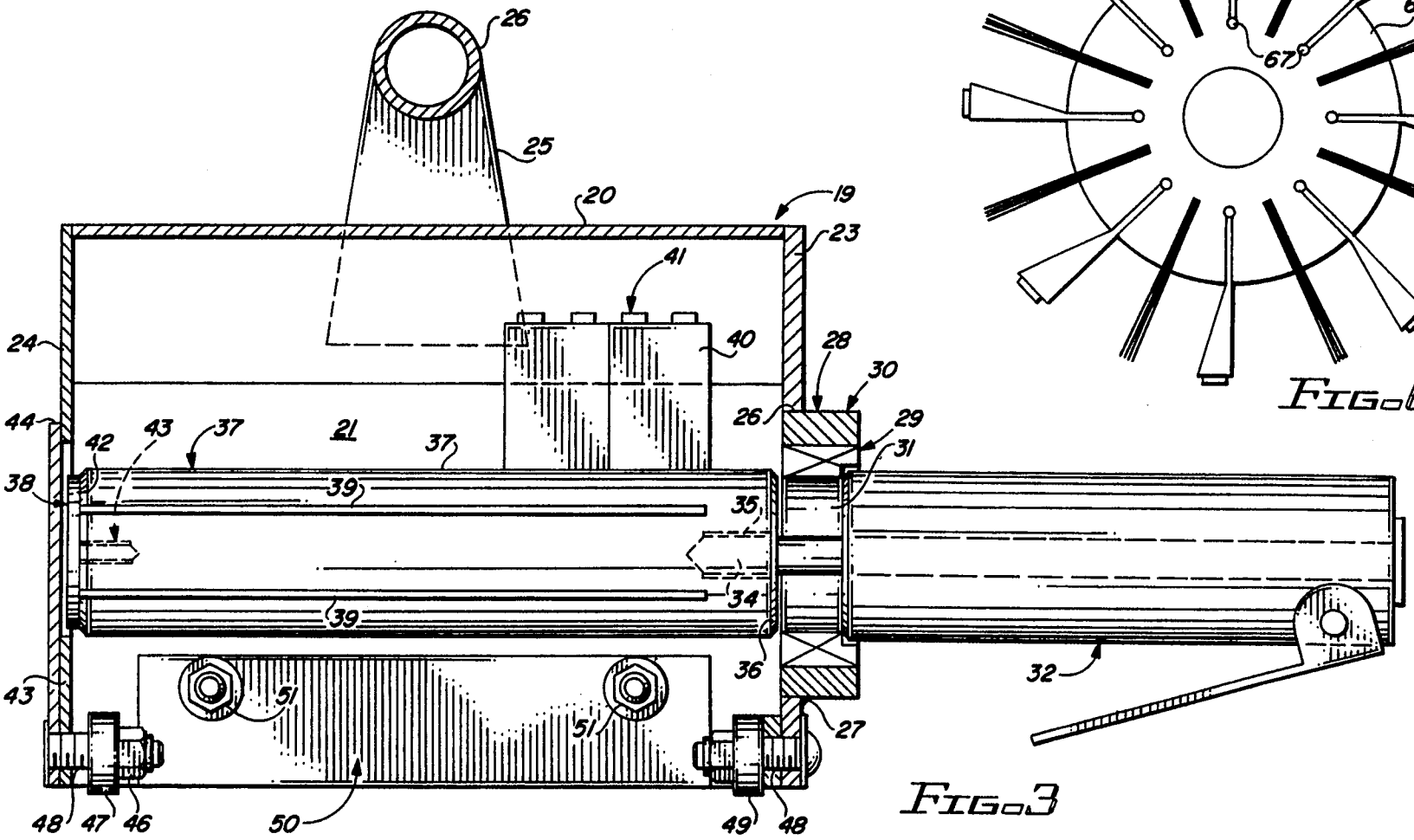
FIG. 3 is a side elevational sectional detailed view of the rotary impact tool of his invention.
Figure 4:
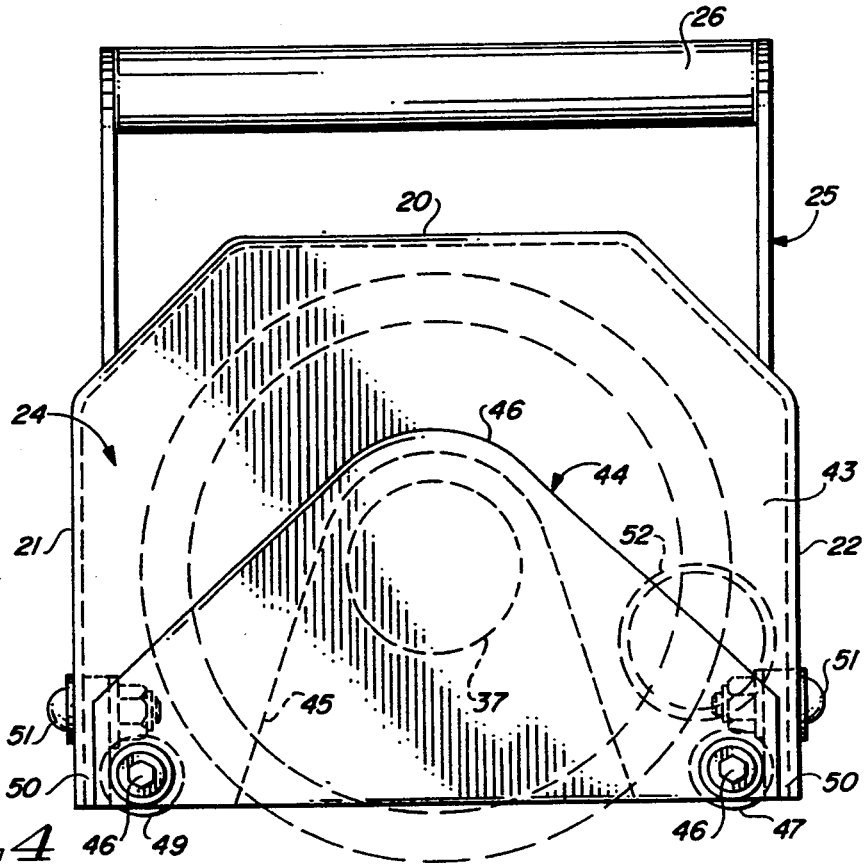
FIG. 4 is an end elevational sectional detailed view of the rotary impact tool.

As shown in FIGS. 3 and 4, the end wall 23, provides a circular opening 26 into which is welded as at 27, a circular collar 28. Projected into the collar 28 is a bushing 29, secured in place by a series of set screws 30. This bushing 29 receives the neck 31 of an air drill 32. The neck 31 of the drill 32 is fastened to the bushing 29 by a series of set screws 33 schematically shown in FIG. 5.

The rotating driven shaft 34 of the air drill 32 is adapted to be press fitted into a receiving aperture 35 formed in the end 36 of a rigid cylindrical brush core 37.

The brush core 37 is circular in configuration and of a length to extend between the end walls 23 and 24. Starting from the distal end 38, the body of the core 37 is slotted as at 39 to receive and retain the interior ends of flexible flap members 40. These receiving slots 39 are of the same longitudinal lengths and are circular in cross section for the reasons hereinafter stated. The flap members 40 are constructed in segments, and it is beneficial to the operation of the tool to arrange them longitudinally offset with each other.

To longitudinally offset the flaps 40, a series of dowel rods with incrementally increasing lengths may be inserted against and to either side of the flaps 40 as they are inserted into the slots 39 in designed relation so as to longitudinally offset the positions of the flaps 40 relative to each other along their respective receiving slots 39. Each of the flaps 40 is provided with a set of peening elements 41 which perform the stripping action upon the surface area defined by the open bottom area of the hood 19.

The distal end 38 of the brush core 37 is provided with a cap 42 secured to the core 37 by a screw 43. This cap 42 is of a size so as to cover the ends of the slots 39 formed in the core 37, and functions to retain the dowel rods and the flap members 40 in their respective positions within the slots 39. The cap 42 may be removed in a manner hereinafter described thus permitting the dowel rods and the flaps 40 to be withdrawn from their respective slots 39.

The opposite end wall 24 consists of two separate partial plates 43 and 44. The plate 43 depends from the top wall 20 and extends between the side walls 21 and 22 of the hood 19 and is welded thereto to be integral therewith. Plate 43 is provided with an access cutout 45 which extends from its bottom edge upwardly between its side edges and terminates into a semi-circular edge which corresponds to the outer circumference of the brush core 37. By such construction the distal end 38 of the brush core 37 is exposed in such access cutout 45.

Figure 5:
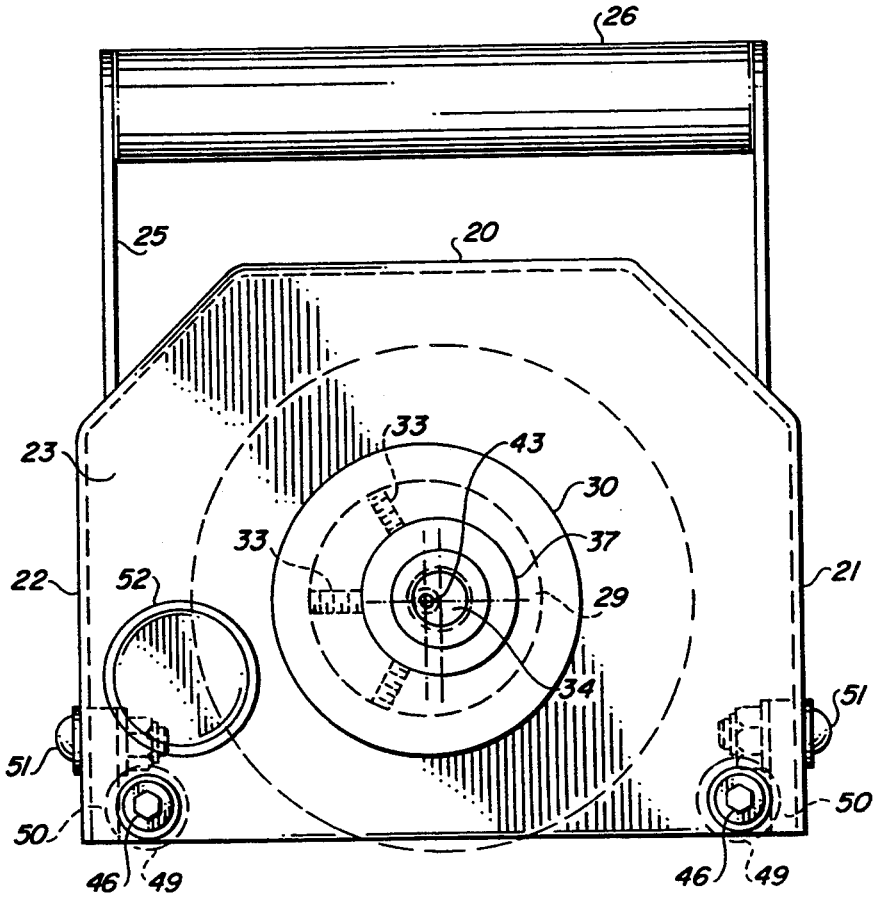
FIG. 5 is an opposite end elevational sectional detailed view of the rotary impact tool.

The second plate 44 is of a width to extend between the side walls 21 and 22 and of a length to define one side edge of the open bottom of the hood 19 (See FIG. 5). The plate 44 provides an elliptical edge 46 that defines a cover for the access cutout 45 formed in the plate 43.

When the plate 44 is removed it exposes the end cap 42 thus providing access to the distal end 38 of the core 37 and receiving slots 39 formed therein.

As shown in FIG. 3 the partial wall plates 43 and 44 are connected by a set of nuts and bolts 46. These nuts and bolts 46 also form the axle for rollers 47 which by spacers 48 are positioned inwardly of the sides of wall plates 43 and 44. Like rollers 49 are mounted adjacent the bottom edges of the end wall 23, as clearly shown in the drawings. These rollers 47 and 49 permit the hood 19 to be moved over the surface to be cleaned.

As seen in FIGS. 4 and 5 the side walls 21 and 22 are of a lesser depth than the end walls 23 and 243 so as to be spaced from the open bottom of hood 19.

Extensions for the bottom edges of the side walls 21 and 22 are provided and consists of resilient strips 50. In the present instance these strips 50 are made from a suitable rubber material, but any shock absorbing material maybe used. The strips 50 are fastened onto the side walls 21 and 22 by a series of nuts and bolts 51.

The strips 50 are so placed so that they extend parallel to the long axis of the brush core 37 and are thus in the path of any material stripped by the rotary action of the flaps 40 and the peening elements 41. Thus the strips 50 will absorb the impact of stripped material and retain the same within the area defined by the hood 19.

Figure 7:
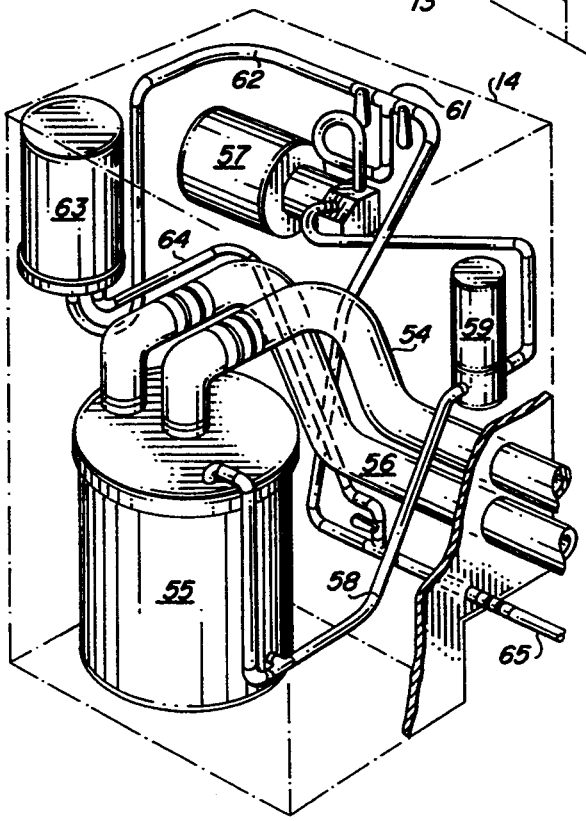
FIG. 7 is a perspective view of a filtration system adapted for use in this invention.

To ensure the environmentally safe action of the brush, the side wall 22 of the hood 19 is provided with a vacuum port 52. This port 52, through a suitable hose connection is operatively connected to a vacuum recovery filter system such as illustrated in FIG. 7.

The recovery vacuum for the rotary brush of this invention is created by a liquid ring pump 53 housed in compartment 16 as shown in FIG. 2. The liquid ring pump 53 is connected by a hose 54 to a liquid/particle separator and Hepa filter 55 housed in compartment 14 (see FIGS. 2 and 3). The separator 55 through a vacuum recovery hose 56 has open communication with the vacuum port 52 formed in the hood 19.

The separator 55 can be of a cyclone type construction which is designed to remove paint chips, dust particles and other recovered contaminates from the air. It is a cylindrical vessel, the interior of which is designed in a spiral corkscrew such that the recovered contaminates will centrifugally lose their velocity and gradually drop to the bottom of the vessel, separating themselves from the air. In the event any liquid is vacuumed it will be drawn by a recirculating pump 57 from the separator 55 through conduit 58 into a final filter element 59 before being returned to the supply tank 60 of the liquid ring pump 53. In the event that the rotary brush of this invention vacuums any oil, ink or dye spills the pump 57 will draw the same through conduit 58, and by way of a then opened three way valve 61 into conduit 62 and through an oil filter 63 before being recirculated through conduits 64 and 65 back to the supply tank 60 of the ring pump 53.

Figure 6:
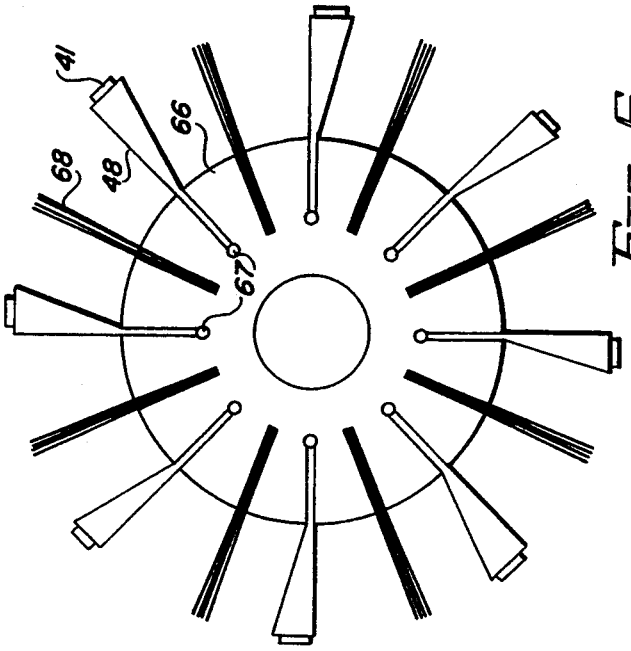
FIG. 6 is an end elevational view of a modified stripping brush core.

FIG. 6 illustrates a modified stripping brush core 66 that is provided with a series of elongated slots 67 which are adapted to receive alternate wire brush strips 68. The wire brush strips 68 should be somewhat longer than the flaps 40 to allow the ends thereof access to pits formed in the surface to be treated. The wire brush strips 68 will aid in removing the paint from the pitted surfaces. The flaps 40 together with their peening elements 41 are not capable of achieving this desirable result.

From the foregoing it is apparent that I have devised a rotary impact tool which is environmentally safe in use. The tool performs a stripping action of the material such as lead paint and provides a vacuum recovery of the same thus preventing external contamination outside the working area of the tool.

While I have illustrated and described the preferred form of construction for carrying my invention into effect, this is capable of variation and modification without departing from the spirit of the invention. I therefore, do not wish to be limited to the precise details of such variations and modification as come within the scope of the appended claims.

Having thus described my invention what I claim as new and novel and desire to protect by Letters Patent is:

1. A surface treating tool including a filtration vacuum for the recovery of material stripped from the surface to be cleaned comprising:

a) a housing providing an opening adapted to be appositioned with the surface to be treated, b) a rotatable surface treating element mounted within said housing, c) said surface treating element providing surface treating members exposed through said opening for impacting upon the surface to be treated, d) an air drill for rotating said element about a longitudinal axis within said housing, and e) means provided by said housing through which a vacuum is introduced into said housing for the recovery of air borne contaminants removed from said surface by said rotatable element.

2. A surface treating tool as defined by claim 1 wherein said surface stripping members comprises a series of radially extending flaps.

3. A surface treating tool as defined by claim 1 wherein said surface stripping members comprises flexible flaps carrying at their free distal ends surface peening elements.

4. A surface treating tool as defined by claim 3 including wire brush strips carried by said rotatable element, with said wire brush strips alternately positioned between said flaps and are of a length to extend radially beyond the peening elements carried at the free distal ends of said flaps.

5. A surface treating tool as defined by claim 1 including means providing a removable connection between said surface treating element and said air drill.

6. A surface treating tool as defined by claim 5 wherein said housing provides means through which said rotatable surface treating element can be disconnected from said means for rotating said element and removed from within said housing.

7. A surface treating tool as defined by claim 6 wherein said means through which said rotatable element is removed from said housing comprises a two piece side wall with one of said side wall pieces being removably connected to the other side wall piece to expose said rotatable element.

8. A surface treating tool as defined by claim 7 including wire brush strips carried by said rotatable element.

* * * * *